US010247373B1

(12) United States Patent
Ladewig et al.

(10) Patent No.: US 10,247,373 B1
(45) Date of Patent: Apr. 2, 2019

(54) LUMINAIRE MOUNTING SYSTEM

(71) Applicants: Christopher Ladewig, Fayetteville, GA (US); Steven D. Lowe, Peachtree City, GA (US); Matthew D. LeClair, Peachtree City, GA (US)

(72) Inventors: Christopher Ladewig, Fayetteville, GA (US); Steven D. Lowe, Peachtree City, GA (US); Matthew D. LeClair, Peachtree City, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/142,460

(22) Filed: Apr. 29, 2016

Related U.S. Application Data

(60) Provisional application No. 62/155,159, filed on Apr. 30, 2015.

(51) Int. Cl.

| | |
|---|---|
| ***F21S 8/04*** | (2006.01) |
| ***F21V 5/04*** | (2006.01) |
| ***F21S 8/06*** | (2006.01) |
| ***F21V 23/00*** | (2015.01) |
| ***F21V 9/30*** | (2018.01) |
| ***F21V 21/008*** | (2006.01) |
| ***F21V 21/16*** | (2006.01) |
| *F21Y 101/02* | (2006.01) |
| *F21Y 103/00* | (2016.01) |

(52) U.S. Cl.
CPC ..... *F21S 8/043* (2013.01); *F21S 8/061* (2013.01); *F21V 5/04* (2013.01); *F21V 9/30* (2018.02); *F21V 21/008* (2013.01); *F21V 21/16* (2013.01); *F21V 23/001* (2013.01); *F21Y 2101/02* (2013.01); *F21Y 2103/003* (2013.01)

(58) Field of Classification Search
CPC ... F21S 8/04; F21S 8/043; F21S 8/046; F21V 21/02; F21V 21/03; F21V 21/16
See application file for complete search history.

(56) References Cited

U.S. PATENT DOCUMENTS

| | | | | |
|---|---|---|---|---|
| 3,506,232 | A * | 4/1970 | Wolar | F21V 21/00 248/320 |
| 9,568,181 | B2 * | 2/2017 | Boomgaarden | F21S 8/026 |
| 2003/0082948 | A1 * | 5/2003 | Hakkarainen | F21S 8/06 439/531 |
| 2015/0055353 | A1 * | 2/2015 | Hutchens | F16M 13/02 362/370 |
| 2015/0109820 | A1 * | 4/2015 | Wilcox | G02B 6/305 362/609 |
| 2017/0159925 | A1 * | 6/2017 | Boomgaarden | F21V 29/71 |
| 2017/0307202 | A1 * | 10/2017 | Maxik | F21K 9/235 |

* cited by examiner

*Primary Examiner* — Thien M Le
*Assistant Examiner* — April Taylor
(74) *Attorney, Agent, or Firm* — King & Spalding LLP

(57) ABSTRACT

A lighting system can include a luminaire and a bracket for mounting the luminaire to a structure during installation. The bracket can be configured for mounting to the structure independent of the luminaire. Once the bracket is mounted, the luminaire can be hung or suspended from the bracket to facilitate wiring the luminaire. Once the hung luminaire is wired, the installer can readily move the luminaire into a long-term operating position with respect to the bracket and fasten the luminaire to the bracket with a clip or other appropriate fastener.

14 Claims, 11 Drawing Sheets

LUMINAIRE MOUNTING SYSTEM

CROSS REFERENCE TO RELATED APPLICATIONS

This application claims priority to U.S. Provisional Patent Application No. 62/155,159 filed Apr. 30, 2015 in the name of Christopher Ladewig, Steven D. Lowe, and Matt D. LeClair and entitled "Luminaire Mounting System," the entire contents of which are hereby incorporated herein by reference.

TECHNICAL FIELD

Embodiments of the technology relate generally to mounting systems for luminaires, and more particularly to brackets for mounting lighting fixtures efficiently and economically.

BACKGROUND

Installing luminaires utilizing conventional technologies can be cumbersome or inefficient. For example, many overhead installations are two-person jobs. In many instances, a person installing a luminaire may need to partially disassemble the fixture during installation.

Accordingly, there are needs in the art for improved technologies for installing luminaires. Need exists for a system that can better manage labor cost or inconvenience in connection with installing a luminaire. Need further exists for improved approaches to mounting luminaires that incorporate light emitting diodes (LEDs), for example to help realize the potential benefit associated with their energy efficiency, light quality, and compact size. A capability addressing one or more such needs, or some other related deficiency in the art, would support improved deployment of illumination systems, including but not limited to more utilization of light emitting diodes in lighting applications.

SUMMARY

A luminaire mounting system can facilitate installing a luminaire, for example reducing labor and improving installation convenience and economics. The mounting system can comprise a lightweight bracket that is initially separated from the luminaire. An installer can readily mount the bracket adjacent or over an existing junction box, without having to cope with the weight and bulk of the luminaire. In some examples, the bracket can comprise captive fasteners for convenient attachment of the bracket to a ceiling or other structure associated with the junction box. In addition to the bracket, the mounting system can comprise hardware that attaches to the luminaire for coupling the luminaire to the bracket. Once the bracket is attached to the ceiling, the installer can readily mount the luminaire to the bracket. The installer can use a hanger to hang the luminaire from the bracket. The installer can then move the luminaire into position against the bracket to provide a long-term operating configuration.

In some examples, multiple hanging configurations can be supported. For example, there may be a first configuration for initial wiring and a second configuration. The second configuration can be intermediate with respect to the first configuration and a final, operating configuration. Such two configurations can utilize two different hangers in some examples.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made below to the accompanying drawings.

Figure 1:
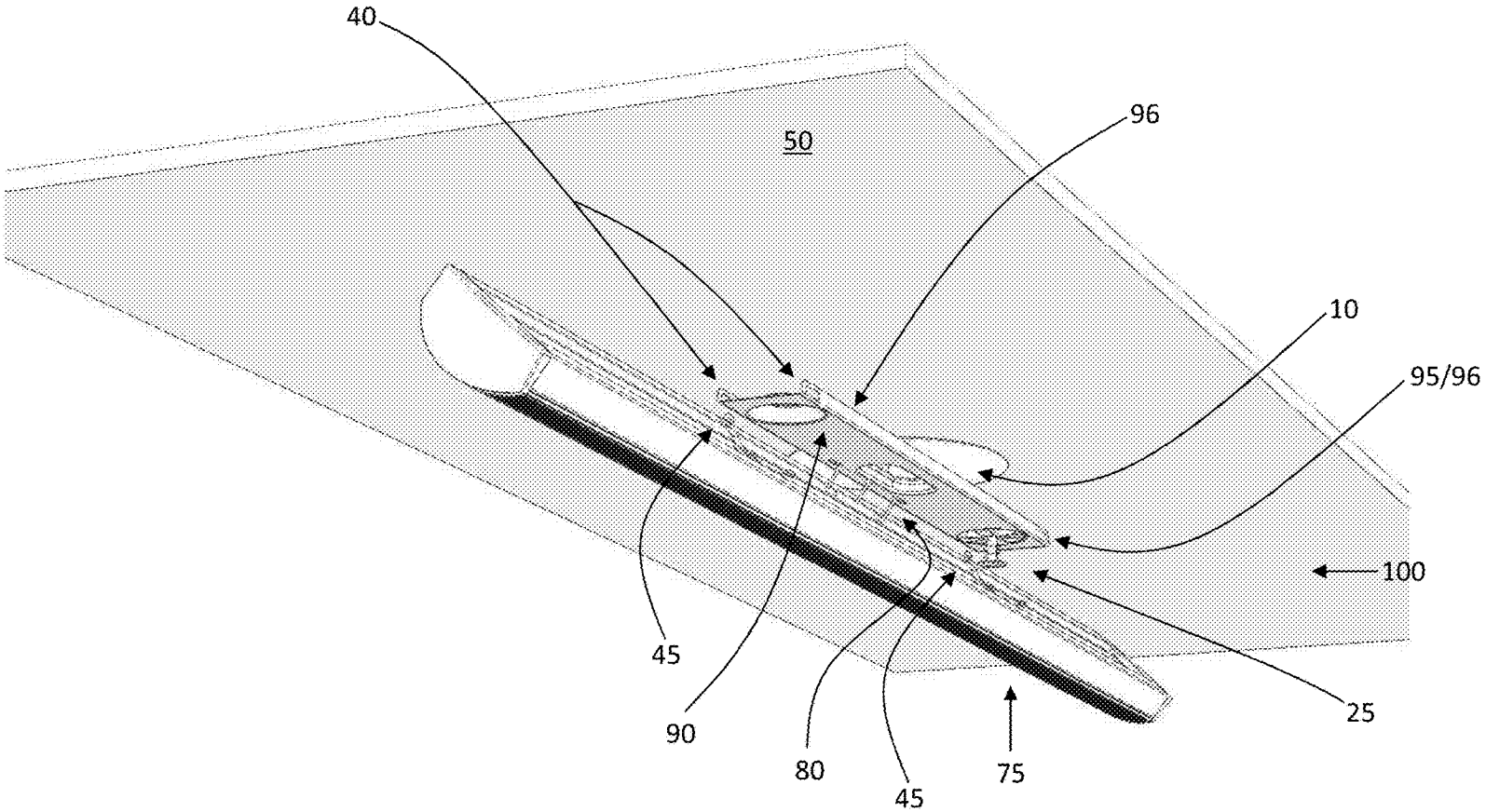
FIG. 1 illustrates a perspective view of an example luminaire mounting system according to some embodiments of the disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DETAILED DESCRIPTION OF EXAMPLE EMBODIMENTS

A lighting system or a luminaire mounting system can comprise a bracket and a hanger. An installer can attach the bracket to a ceiling or other structure while the bracket is detached from an associated luminaire. In some (but not all) examples, the bracket can include captive fasteners to facilitate installation. Once the bracket is attached to the ceiling, the installer can use the hanger to hang or suspend the luminaire from the bracket. Once the luminaire is hung or suspended from the bracket, the installer can move the luminaire into position against the bracket to provide a long-term operating configuration, for example utilizing one or more clips or other fasteners to fasten the luminaire against the bracket. In some examples, the lighting system can provide two hanging configurations, a first for wiring the luminaire and a second for tucking the wiring into a recess prior to moving the luminaire into the long-term operating configuration. The second hanging configuration can provide an intermediate position between the first hanging configuration and the long-term operating configuration, for example.

Some representative embodiments will be described more fully hereinafter with example reference to the accompanying drawings that illustrate representative embodiments of the technology. The technology may, however, be embodied in many different forms and should not be construed as limited to the embodiments set forth herein; rather, these embodiments are provided so that this disclosure will be thorough and complete and will fully convey the scope of the technology to those appropriately skilled in the art. FIGS. 1, 2, 3, 4, 5, and 6 illustrate one example embodiment of a luminaire mounting system 100, while FIGS. 7, 8, and 9 illustrate another example embodiment of a luminaire mounting system 700.

Figure 2:
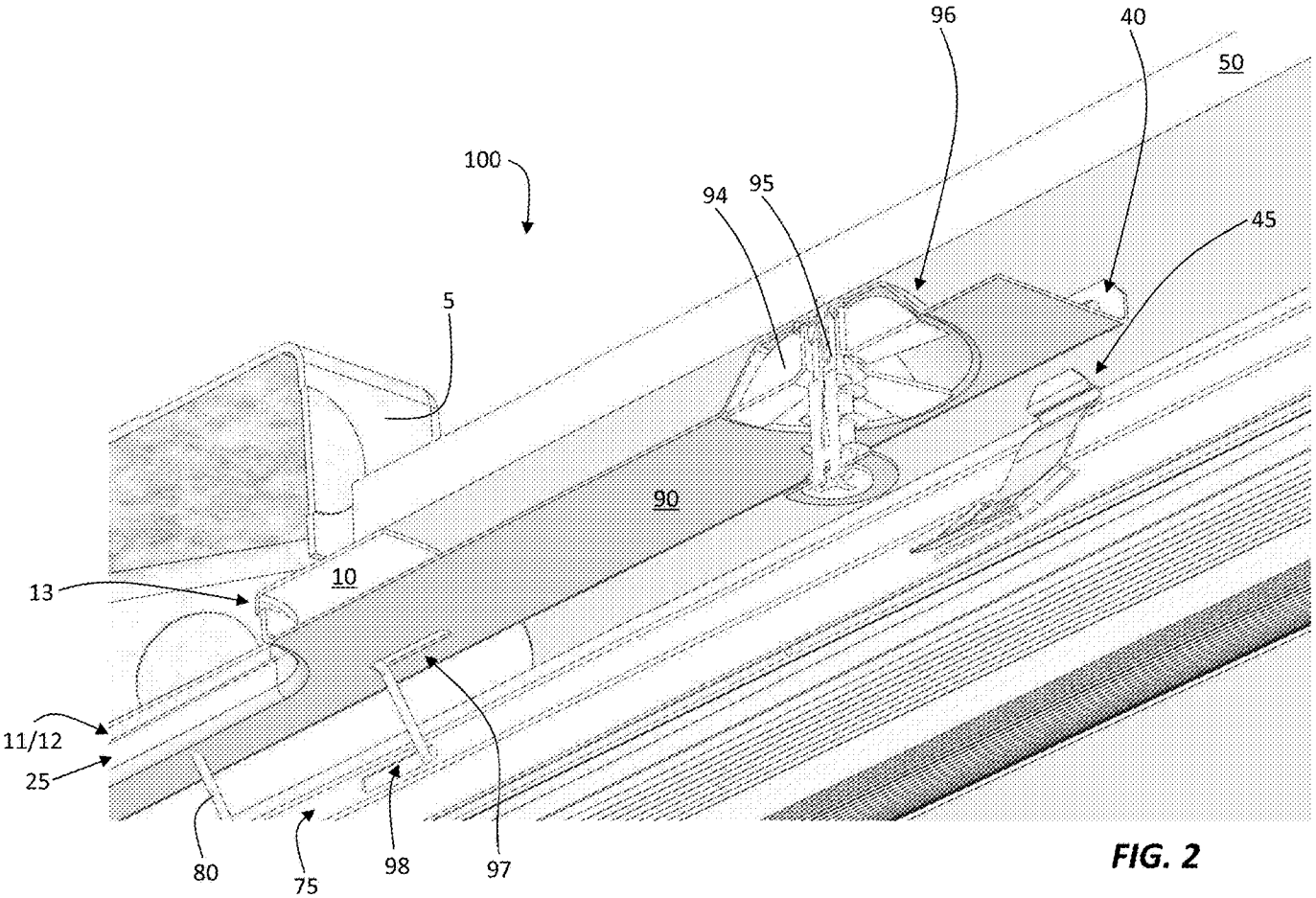
FIG. 2 illustrates a perspective cross sectional view of the example luminaire mounting system, in which the section is taken lengthwise, according to some embodiments of the disclosure.
Figure 3:
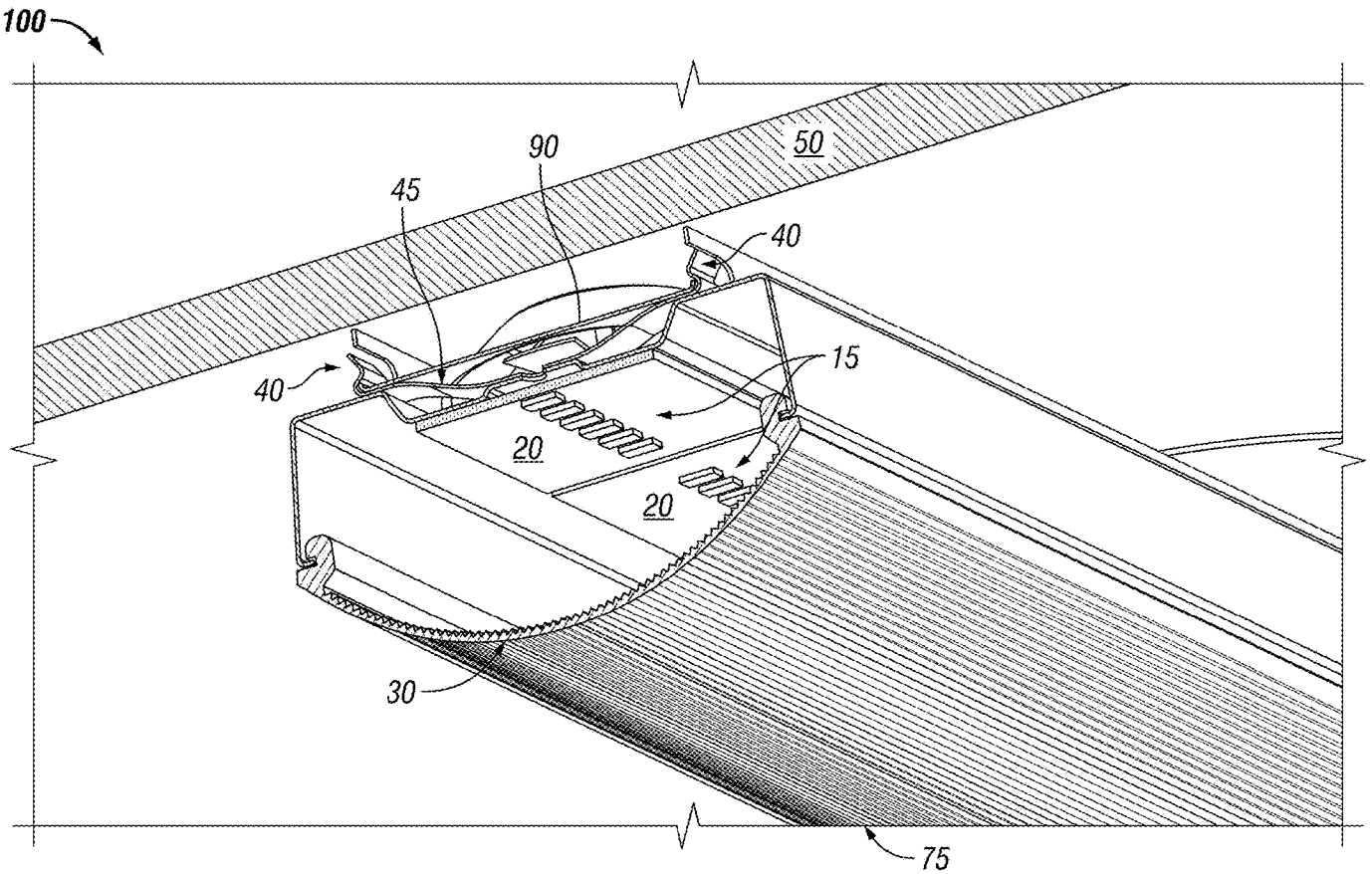
FIG. 3 illustrates a perspective cross sectional view of the example luminaire mounting system, where the section is taken crosswise, according to some embodiments of the disclosure.
Figure 4:
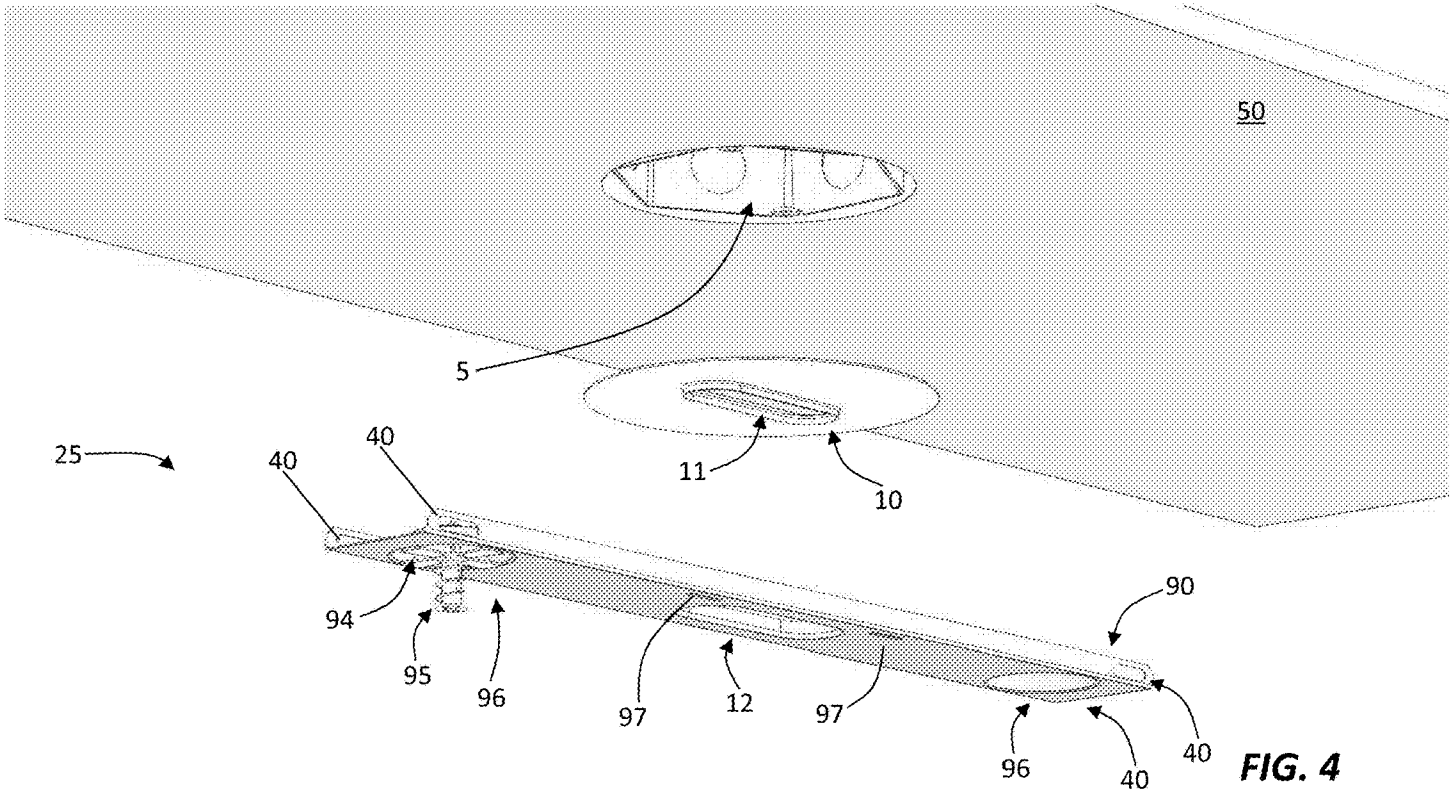
FIG. 4 illustrates an exploded view of some representative components of the example luminaire mounting system, according to some embodiments of the disclosure.
Figure 5:
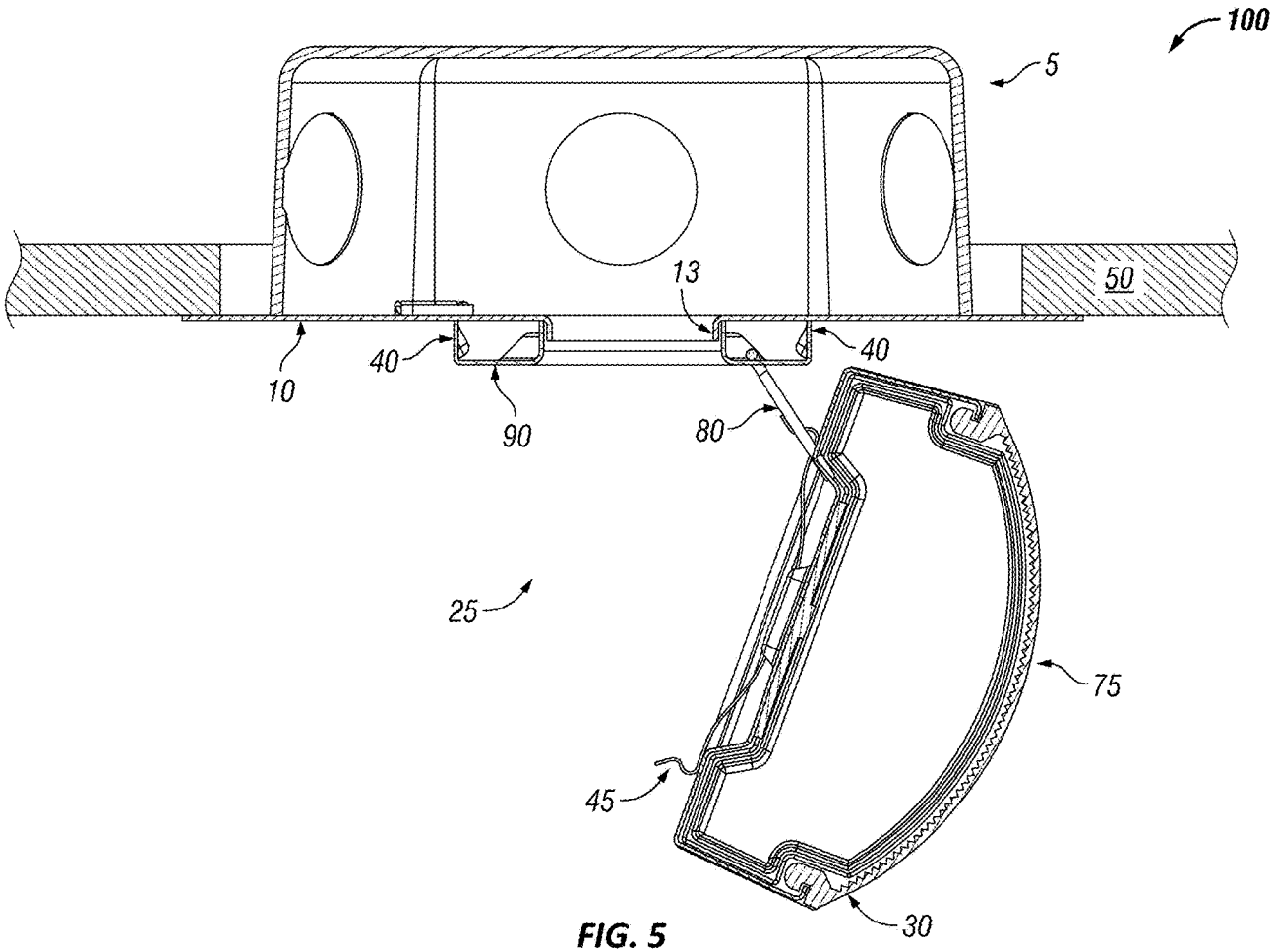
FIG. 5 illustrates a cross sectional view of the example luminaire mounting system, where the section is taken crosswise, with the luminaire suspended or hanging from a bracket according to some embodiments of the disclosure.
Figure 6:
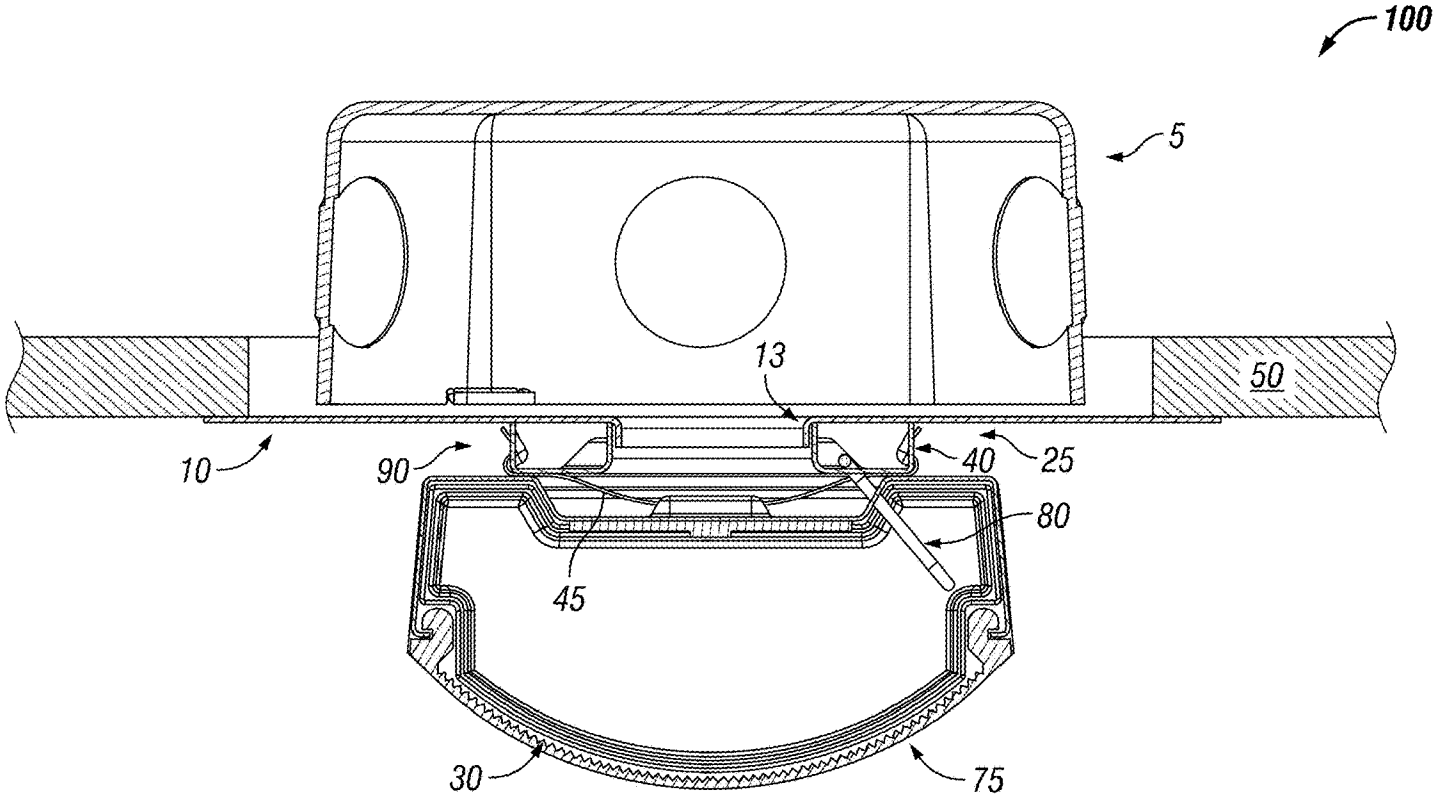
FIG. 6 illustrates a cross sectional view of the example luminaire mounting system, where the section is taken crosswise and the luminaire is fixed to the bracket in an operating configuration, according to some embodiments of the disclosure.

Turning now to FIGS. 1, 2, 3, 4, 5, and 6, the example luminaire mounting system 100 will be discussed in further detail. FIG. 1 illustrates a perspective view of the luminaire mounting system 100. FIG. 2 illustrates a perspective cross sectional view of the luminaire mounting system 100, in which the section is taken lengthwise. FIG. 3 illustrates a perspective cross sectional view of the luminaire mounting system 100, in which the section is taken crosswise. FIG. 4 illustrates an exploded view of some representative components of the luminaire mounting system 100. FIG. 5 illustrates a cross sectional view of the luminaire mounting system 100, in which the section is taken crosswise, with the luminaire 75 suspended or hanging from a bracket 90. FIG. 6 illustrates a cross sectional view of the luminaire mounting system 100, in which the section is taken crosswise and the luminaire 75 is fixed to the bracket 90 in an operating configuration.

Referring to FIGS. 1, 2, 3, 4, 5, and 6, in the illustrated embodiment, the example luminaire mounting system 100 comprises mounting hardware 25 for mounting the luminaire 75 to a ceiling 50 adjacent a junction box 5 that is set into an aperture of the ceiling 50. Other embodiments supported by the present disclosure and teaching may mount to various other vertical and horizontal structures, including both indoor and outdoor applications.

A cover plate 10 is sized to fit over the junction box 5 and can be viewed as a flange in the illustrated embodiment. As illustrated, the cover plate 10 comprises a circular plate with a central opening 11. The central opening 11 is sized to accommodate a power feed, so that electrical wires extend from the junction box 5 and into the luminaire 75 via the central opening 11.

As shown in the exploded view of FIG. 4, a bracket 90 mounts to the ceiling 50 over the cover plate 10, so that the cover plate 10 is located between the bracket 90 and the junction box 5. The bracket 90 comprises an opening 12 that corresponds to and aligns with the opening 11 of the cover plate 10. Electrical lines thus feed readily through both openings 11, 12.

As best seen in FIGS. 2, 5, and 6, the central opening 11 of the cover plate 10 flares downward, and the central opening 12 of the bracket 90 flares upward. Thus, the two openings 11, 12 have deformed peripheries, one bent up and the other bent down. The two flared regions 13 mate with one another. In some embodiments, the two flared regions 13 have a slight interference fit so that they may bind together when mated during installation. In some other embodiments, the flared regions 13 are sized to avoid binding or interference. For example, an annular gap can exist between the two flared regions 13 after mating and installation.

In the illustrated example embodiment, the bracket 90 further comprises mounting fasteners 95 that are captured in fastener apertures 96. As best seen in FIGS. 2 and 4, the fastener apertures 96 of the bracket have deformable plastic inserts 94 that retain the fasteners 95 with the bracket 90 while the installer maneuvers the bracket 90 into position. (In some other example embodiments, the fasteners 95 may also be captured in bent/perforated metal of the bracket 90.) Thus in this illustrated embodiment, the installer can carry the bracket 90 up a ladder without worrying about the fasteners 95 falling out and without having to carry separately and keep up with loose, detached fasteners. Moreover, when the installer moves the bracket 90 into a desired position against the ceiling 50, the fasteners 95 are inherently oriented for deployment so that the installer can readily mount the bracket 90 to the ceiling 50.

Once the installer moves the lightweight bracket 90 into position, the installer can readily advance the fasteners 95 through the respective fastener openings 96 and into the ceiling 50. For example, the installer may use a manual or battery powered screwdriver. In some example embodiments, the fasteners 95 comprise drywall fasteners or anchors. As the installer rotates each fastener 95, the fastener 95 screws into and deforms the associated deformable plastic insert 94. The fastener 95 thus protrudes out of the rear of the bracket 90 and into the ceiling 50, thereby securing the bracket 90 to the ceiling 50 or other structure.

With the bracket 90 mounted to the ceiling 50, the luminaire mounting system 100 is ready for the installer to hang the luminaire 75 from the bracket 90. As best shown in FIGS. 1 and 5, the luminaire mounting system comprises a hanger 80 for hanging or suspending the luminaire 75 from the bracket 90. In some embodiments the hanger 80 is pre-attached to the bracket 90, so that the hanger 80 is with the bracket 90 while the bracket 90 is mounted to the ceiling 50 as discussed above. However, in the illustrated embodiment, the hanger 80 accompanies the luminaire 75 during bracket mounting. The hanger 80 may be attached to the luminaire 75 during luminaire manufacture or attached to the bracket 90 during bracket manufacture. Alternatively, the installer may attach the hanger 80 to the luminaire 75 or to the bracket 90 at the installation site.

In the illustrated embodiment, the hanger 80 comprises a spring wire formed into a U-shape. A portion of the hanger 80 is positioned in a channel 98 within the luminaire 75 and has freedom of movement within the constraints of that channel 98. (See FIG. 2.) Another portion of the hanger 80 protrudes from the luminaire 75. The protruding portion of the hanger 80 comprises the "legs" of the "U," which may be either splayed out or bent in when the hanger 80 is in a relaxed position. The end of each hanger leg may comprise a sharp bend inward or outward, for example at approximately a right angle. The bracket comprises slots 97 for receiving the ends of the legs of the hanger 80.

To hang or suspend the luminaire 75 from the bracket 90, the installer can maneuver the leg ends of the hanger 80 into the slots 97, for example by temporarily deforming or flexing the spring wire of the hanger 80. Once the installer has worked the leg ends of the hanger 80 into the slots 97, the hanger 80 supports the luminaire 75. Thus, the luminaire 75 hangs or is suspended from the bracket 90 as illustrated in FIGS. 1 and 5.

The hanger 90 provides sufficient freedom-of-movement so that the installer can move the luminaire 75 up and down and operates as a hinge for tilting or rotation. Accordingly, the installer can handily lift and tilt the luminaire 75 into its operating position against the bracket 90.

The luminaire 75 comprises a retention clip 45 and the bracket 90 comprises retention openings 40 that cooperatively hold the luminaire 75 in its operating position against the bracket 90. In an example embodiment, the retention clip 45 is formed of a strip of spring steel and has bent ends that seat in the retention openings 40. When the installer lifts and tilts the luminaire 75 into position, the retention clip 45 flexes and deforms until the ends of the retention clip 45 spring or snap into the retention openings 40, thereby fixing the luminaire 75 against the bracket 90 for long-term operation. See FIGS. 2, 3, and 6.

In the illustrated embodiment, the luminaire 75 incorporates light emitting diodes 15 for illumination and has an elongate geometry. The light emitting diodes 15 are positioned in groups on substrates to form light modules 20. A row of the light modules 20 extends along the elongated dimension of the luminaire 75. Light from the light modules 20 is incident on and refracted by a lens 30. In the illustrated embodiment, the lens 30 comprises lengthwise extending features, specifically grooves and ridges, for diffusing the emitted light.

While one representative luminaire 75 based on light emitting diodes 15 is illustrated in FIGS. 1, 2, 3, 4, 5, and 6, the disclosed mounting technology can support a wide variety of lighting fixtures that may be based on light emitting diodes, incandescent bulbs, or fluorescent lights, to mention a few representative illumination examples without limitation.

Figures 7A, 7B:
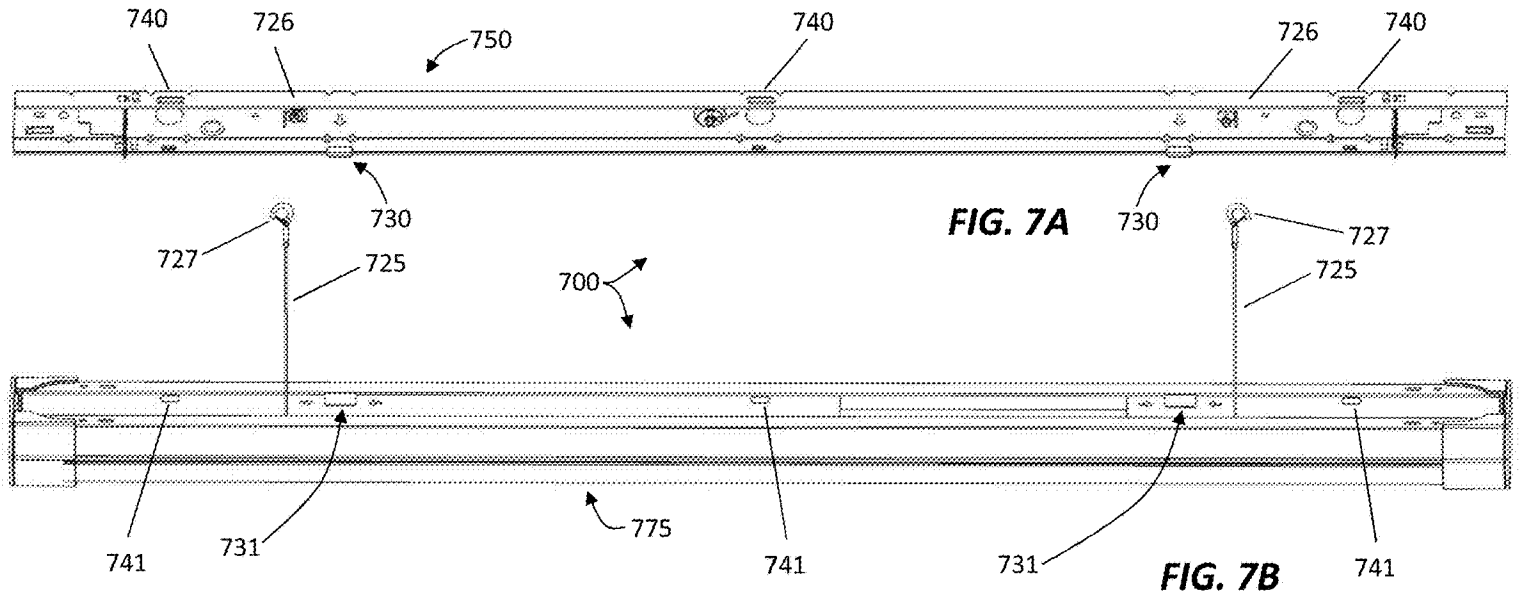
FIGS. 7A and 7B (collectively FIG. 7) illustrate an example lighting system that comprises an example luminaire and an example bracket according to some embodiments of the disclosure.
Figure 8A:
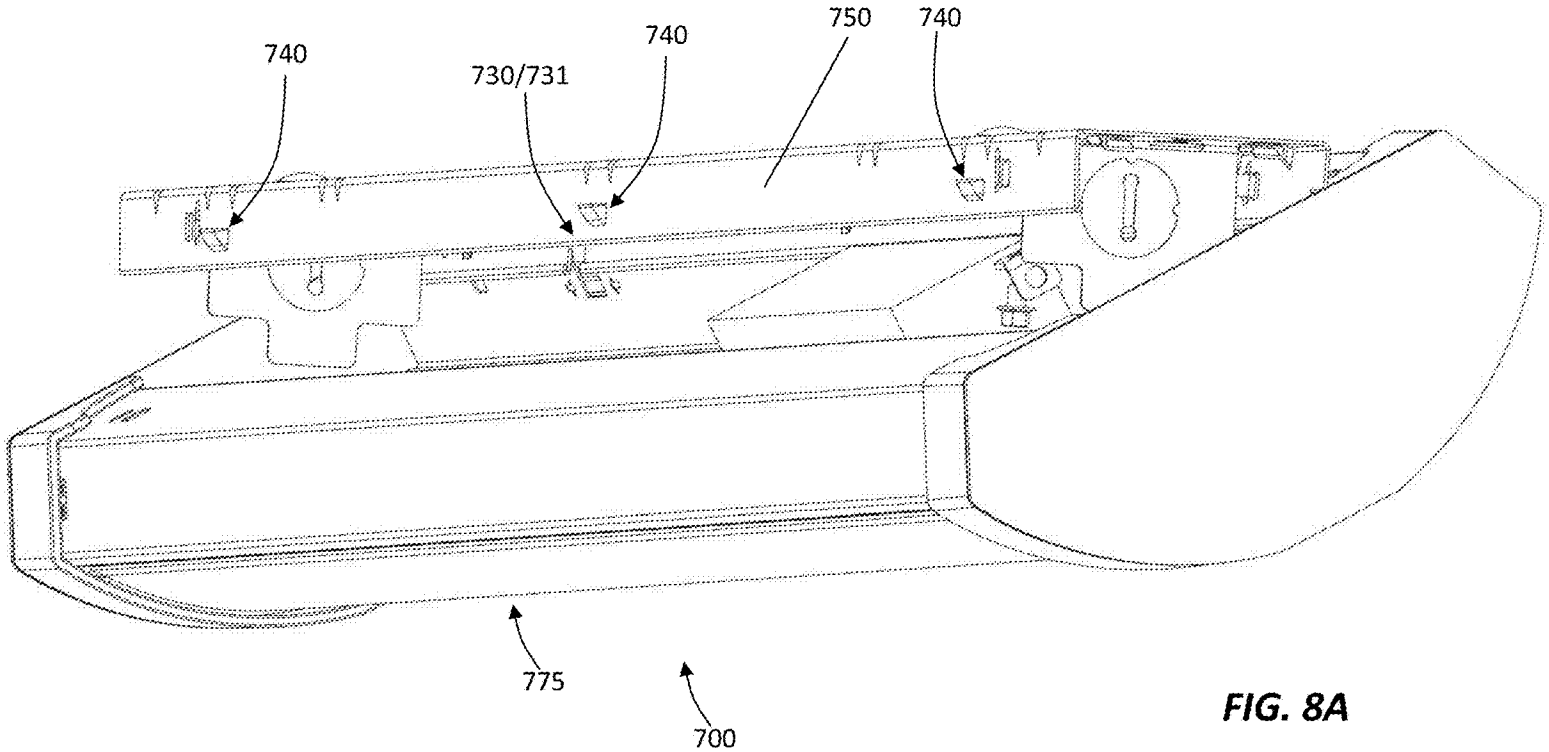
FIGS. 8A, 8B, and 8C (collectively FIG. 8) illustrate three views of the example lighting system of FIG. 7 in a partially installed configuration according to some embodiments of the disclosure.
Figure 8B:
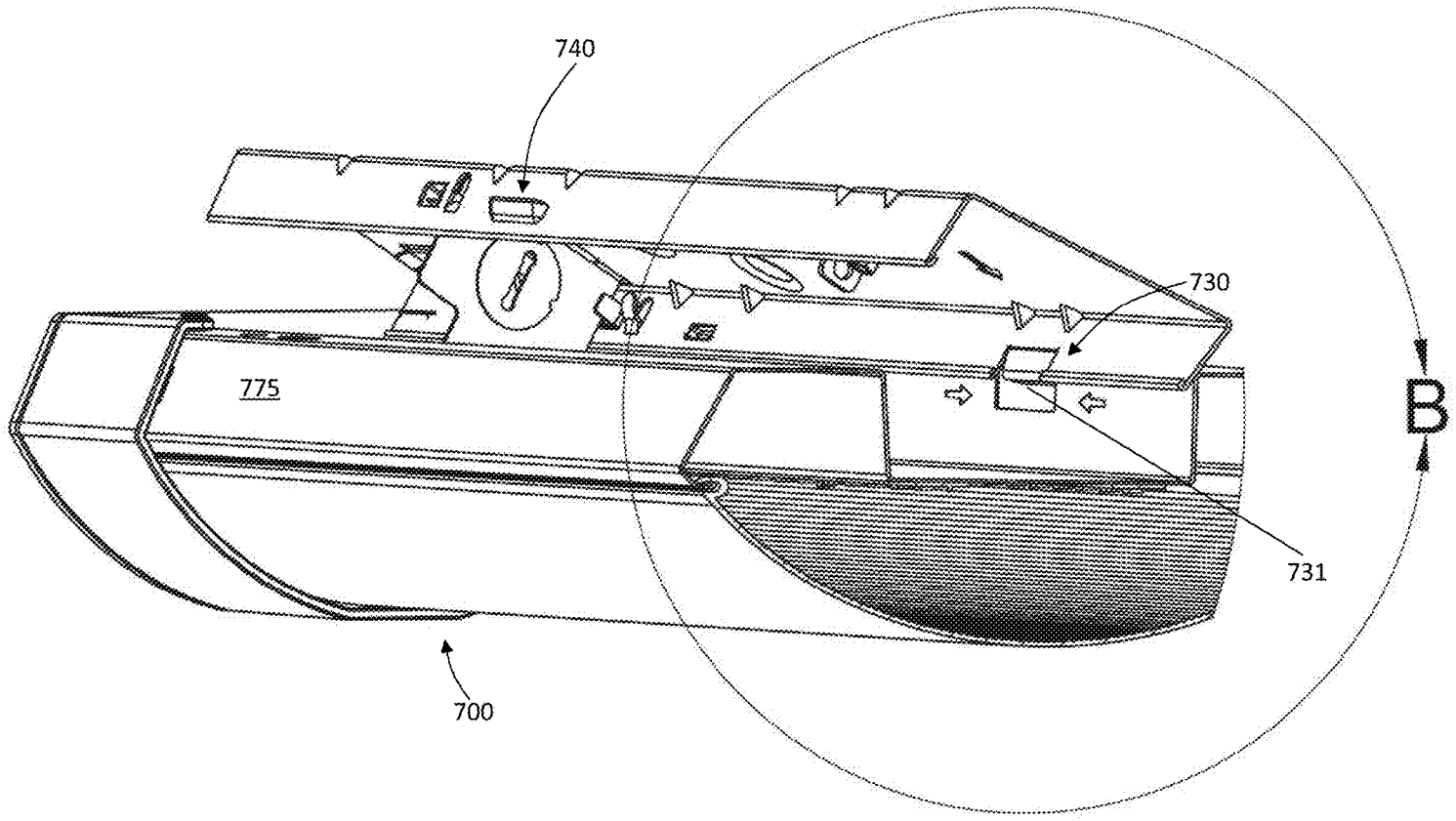
Figure 8C:
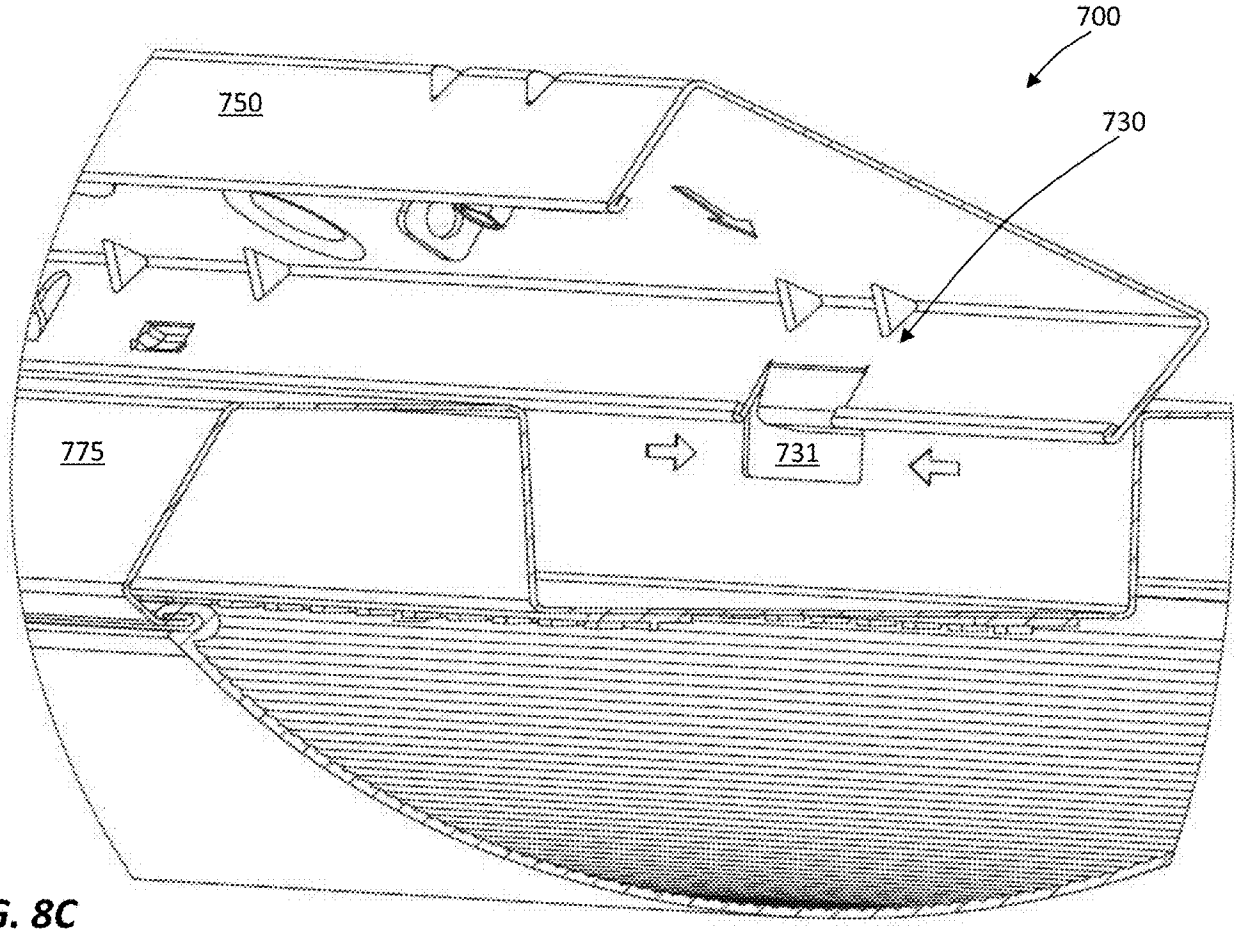
Figure 9:
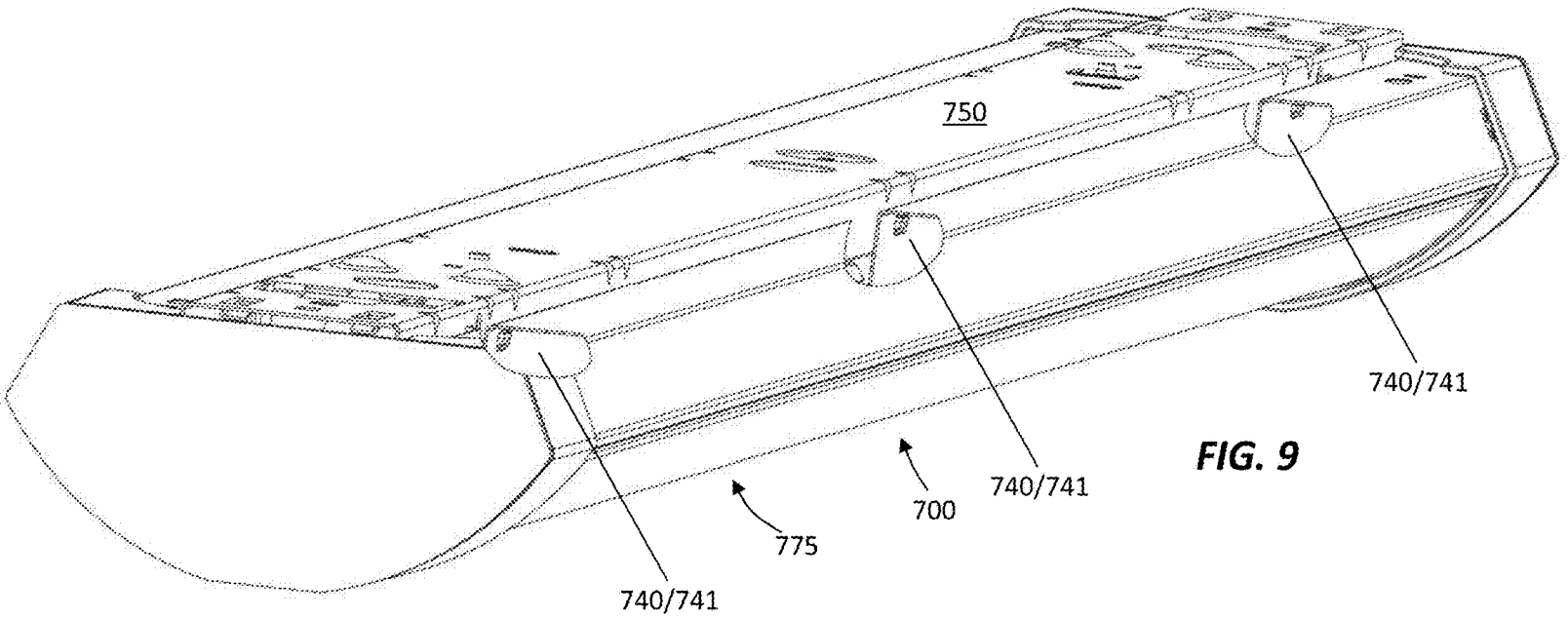
FIG. 9 illustrates a perspective view of the example lighting system of FIGS. 7 and 8 in a fully installed configuration according to some embodiments of the disclosure.

Turning now to FIGS. 7, 8, 9, another example embodiment of a luminaire mounting system 700 is illustrated. The series of figures illustrate three representative, progressive steps in mounting a luminaire 775 using a bracket 750. FIGS. 7A and 7B illustrate the example luminaire 775 positioned immediately below the corresponding bracket 750 for the luminaire 775. FIG. 8A illustrates a perspective view of the luminaire mounting system 700 hanging from the bracket 750 in a hinged configuration. FIG. 8B illustrates a perspective cutaway view of the luminaire mounting system 700 hanging from the bracket 750 as illustrated in FIG. 8A. FIG. 8C illustrates a magnified view of the "B" area of FIG. 8B. FIG. 9 illustrates a perspective view of the luminaire mounting system 750 with the luminaire 775 attached to the bracket 750 in an operating configuration.

As illustrated in FIG. 7A, the installer can attach the bracket 750 to a ceiling or other structure (where a representative ceiling 50 is illustrated in FIG. 1 but not in FIG. 7A). The attachment can utilize captive fasteners or conventional nails, screws, or bolts or other appropriate fastening technology, for example. Once the bracket 750 is mounted to an appropriate structure, the installer can position the luminaire 775 in alignment with the bracket 750, for example below the bracket 750 as illustrated in FIG. 7B.

In the illustrated embodiment, the luminaire 775 comprises cables 725 for hanging or suspending the luminaire 775 from the mounted bracket 750. In some representative embodiments, the cables 725 can comprise metal wires, filaments, cordage, twine, braided plastic or metal filaments, rope, or other appropriate material. In the illustrated embodiment, each cable 725 comprises a hook or clip 727 that the installer can readily fasten to a corresponding feature 726 in the bracket 750. In various example embodiments, the feature 726 can comprise a hole in the frame of the bracket 750, a loop of wire, a ring, an eye, a receptacle, or some other appropriate feature.

Once the installer has hung the luminaire 775 from the bracket 750 via the cables 725, the installer can wire the luminaire 775. That is, the installer can connect pigtail wiring (not illustrated in FIG. 7) of the luminaire 775 to the utility power lines. The resulting electrical connections can be situated in a junction box or other appropriate enclosure.

In the illustrated embodiment of FIGS. 7A and 7B, the cables 725 are pre-attached to the luminaire 775, and the installer makes the cable attachment to the bracket 750. In other embodiments, the cables 725 are pre-attached to the bracket 750, and the installer connects them to the luminaire 775. In some example embodiments, the cables 725 arrive at a jobsite un-attached to the luminaire 775 and un-attached to the bracket 750, and the installer can select the bracket 750 or the luminaire 775 for the initial connection as desired. Then, once the installer has positioned the luminaire 775 adjacent the bracket 750, the installer can make the connection to the other of the bracket 750 and the luminaire 775.

Once the installer has hung the luminaire 775 from the bracket 750 and the luminaire 775 is suspended, the installer can readily move the luminaire 775 closer to the bracket 750 and hang the luminaire 775 in another configuration as illustrated in FIGS. 8A, 8B, and 8C. In this intermediate configuration, the installer can tuck the wiring into the junction box or another appropriate space in the luminaire 775 or the bracket 750 or in a space provided between the luminaire 775 and the bracket 750.

The luminaire mounting system 700 can comprise a hinged connection that facilitates the second hanging configuration. As best seen in FIGS. 7A, 7B and 8C, in the illustrated embodiment, the luminaire 775 comprises two apertures 731 and the bracket 750 comprises two corresponding hooks 730 that form an example, hinged connection. The hooks 730 can be created by deforming a tabbed section of the bracket 750 to create a sharp bend that is suitable for catching an edge of the aperture 731. Thus, the installer can lift the luminaire 775 and hang the apertures 731 from the hooks 730. In this manner, the installer can rotate the luminaire 775 about an axis of rotation that extends between each pair of hooks 730 and apertures 731. Accordingly, the installer can transition the luminaire 775 from the initial hanging position to the intermediate position illustrated in FIGS. 8A, 8B, and 8C and make final preparation for completing the installation.

The installer can then rotate the luminaire 775 about that axis, like a closing door, to complete the installation as illustrated in FIG. 9. When the installer rotates the luminaire 775 closed, nubs 740 on the bracket 750 move into corresponding apertures 741 in the luminaire 775 and catch. The nubs 740 can comprise protrusions formed in the bracket 750, for example. The frames of the bracket 750 and luminaire 775 can deflect sufficiently so that the nubs 740 seat in the apertures 741, thereby securing the luminaire 775 in the closed position for long-term operation.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A system for mounting a luminaire to a structure, the system comprising:

a bracket sized for mounting to the structure adjacent a junction box, the bracket comprising two holes, each of the two holes comprising a deformable insert and a mounting fastener retained by the deformable insert when the bracket is separated from the structure and from the luminaire, the mounting fasteners operative to mount the bracket to the structure;

a hanger operative to hang the luminaire from the bracket after the bracket is mounted to the structure; and one or more luminaire fasteners operative to fasten the luminaire to the bracket once the luminaire is hung from the bracket.

2. The system of claim 1, wherein the hanger comprises a wire.

3. The system of claim 1, wherein the hanger comprises a U-shaped spring that fits into a channel of the luminaire and comprises an end that fits into a slot of the bracket.

4. The system of claim 1, wherein the hanger comprises a member that functions as a hinge.

5. The system of claim 1, wherein each of the one or more luminaire fasteners comprises a member that snaps into a corresponding aperture.

6. The system of claim 1, wherein the bracket is configured to mount over the junction box and comprises a flared opening for passing wiring between the junction box and the luminaire.

7. The system of claim 6, further comprising a cover plate that mounts between the bracket and the junction box, the cover plate comprising a cover plate flared opening that engages the flared opening of the bracket.

8. A lighting system comprising:

a luminaire;

a bracket sized for mounting to a ceiling adjacent to a junction box;

a hanger operative to hang the luminaire from the bracket after the bracket is mounted to the ceiling, the hanger comprising a U-shaped spring that fits into a channel of the luminaire and comprising an end that fits into a slot of the bracket; and one or more clips operative to clip the luminaire to the bracket after the luminaire is hung from the bracket, the one or more clips comprising a strip of spring steel that wraps around the bracket and comprising an end that fits into an aperture on a side of the bracket.

9. The system of claim 8, wherein the hanger is attached to the luminaire prior to hanging the luminaire from the bracket, and wherein the luminaire comprises at least one light emitting diode for emitting illumination.

10. The system of claim 8, further comprising one or more fasteners that are retained in one or more holes in the bracket with the bracket separated from the ceiling and from the luminaire, the fasteners operative to mount the bracket to the ceiling, and wherein each of the one or more fasteners comprises a dry wall anchor.

11. The system of claim 8, wherein the bracket is configured to mount over the junction box and comprises an opening for passing wiring between the junction box and the luminaire, and wherein when the luminaire is hung from the bracket, the hanger provides the luminaire with sufficient tilting freedom-of-motion and vertical translation freedom-of-motion so that an installer can raise the luminaire to the bracket and the one or more clips can fix the luminaire at the bracket in a long-term operation position.

12. A lighting system comprising:

a luminaire that extends lengthwise in a direction and that comprises:

a row of light emitting diodes that extends in the direction;

a lens that extends in the direction adjacent the row of light emitting diodes and that is operative to diffuse light emitted by the row of light emitting diodes; and two apertures along a first side of the luminaire;

a bracket that extends lengthwise, that is separable from the luminaire, and that is configured for mounting to a ceiling, the bracket comprising two hooks along a first side of the bracket; and one or more hangers configured for hanging the luminaire from the bracket in a first position to facilitate wiring connections installation once the bracket is mounted to the ceiling, wherein, after making the wiring connections, the two hooks of the bracket are inserted into the two apertures of the luminaire to hang the luminaire in an intermediate configuration for tucking the wiring.

13. The lighting system of claim 12, wherein said one or more hangers comprises one or more wires, one or more springs, one or more cables, or one or more hinges, and wherein the lighting system further comprises one or more clips operative to clip the luminaire to the bracket after the luminaire is hung from the bracket.

14. The lighting system of claim 13, wherein the bracket is configured to mount over a junction box and comprises an opening for passing wiring between the junction box and the luminaire, wherein when the luminaire is hung from the bracket, the one or more hangers provides the luminaire with sufficient tilting freedom-of-motion and vertical translation freedom-of-motion so that an installer can raise the luminaire to the bracket and can fix the luminaire at the bracket in a long-term operation position, and wherein, when the bracket is mounted to the ceiling and the luminaire is fixed to the bracket, the bracket extends lengthwise in the direction of the row of light emitting diodes.

* * * * *